US006390295B2

(12) United States Patent
Rhee

(10) Patent No.: US 6,390,295 B2
(45) **Date of Patent: *May 21, 2002**

(54) GOLF BAG ASSEMBLAGE

(75) Inventor: Yong S. Rhee, Seoul (KR)

(73) Assignee: Jason Industries, Inc. (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/492,225

(22) Filed: Jan. 27, 2000

(51) Int. Cl.[7] ..... A63B 55/04
(52) U.S. Cl. ..... 206/315.7; 248/96
(58) Field of Search ..... 206/315.7, 315.3; 248/96

(56) References Cited

U.S. PATENT DOCUMENTS

| | | | | | |
|---|---|---|---|---|---|
| 1,197,298 | A | | 9/1916 | McGregor | |
| 1,791,188 | A | | 2/1931 | Bright | |
| 2,571,088 | A | | 10/1951 | Walton | |
| 5,042,654 | A | | 8/1991 | Jones | |
| 5,154,377 | A | | 10/1992 | Suk | |
| 5,209,350 | A | * | 5/1993 | Maeng | 206/315.7 |
| 5,236,085 | A | | 8/1993 | Quellais | |
| 5,339,951 | A | * | 8/1994 | Chen | 206/315.7 |
| 5,340,063 | A | | 8/1994 | Hsieh | |
| 5,351,921 | A | * | 10/1994 | Chen | 206/315.7 X |
| 5,356,003 | A | | 10/1994 | Gretz et al. | |
| 5,407,155 | A | | 4/1995 | Chung | |
| 5,415,285 | A | | 5/1995 | Reimers | |
| 5,464,180 | A | | 11/1995 | Cheng | |
| 5,507,384 | A | | 4/1996 | Maeng | |
| 5,516,064 | A | | 5/1996 | Hsieh | |
| 5,607,128 | A | | 3/1997 | Suk | |
| 5,816,399 | A | | 10/1998 | Rhee | |
| 5,829,719 | A | * | 11/1998 | Han | 206/315.7 X |
| 5,901,845 | A | * | 5/1999 | Cheng | 206/315.7 |
| 5,996,789 | A | * | 12/1999 | Suggs et al. | 206/315.7 X |
| 6,010,101 | A | * | 1/2000 | Stein et al. | 206/315.7 X |
| 6,062,383 | A | * | 8/2000 | Han | 206/315.7 |
| 6,098,797 | A | * | 8/2000 | Han | 206/315.7 |

* cited by examiner

*Primary Examiner*—Lee Young
*Assistant Examiner*—Tri M. Mai
(74) *Attorney, Agent, or Firm*—Fisher, Christen & Sabol

(57) ABSTRACT

A golf bag assemblage which includes an elongated container for golf clubs, a bottom unit pivotally attached to the bottom of the elongated container so that the bottom unit pivots in relation to the bottom of the elongated container, and leg means attached by attachment means to the outside of upper portion of the elongated container. The attachment means are positioned diametric to the pivotal attachment of the bottom unit, the leg means include legs which are pivotally attached to the attachment means, and the push rod means are attached to the top region of the legs and to the bottom unit diametric to the pivotal attachment of the bottom unit. When the golf bag is tilted in direction diametric to the pivotal attachment of the bottom unit, the bottom unit, in effect, pivots in relation to the bottom of the elongated container, and the push rod means is moved towards the top of the elongated container, thereby pivoting the legs outward.

4 Claims, 6 Drawing Sheets

GOLF BAG ASSEMBLAGE

BACKGROUND OF THE INVENTION

1. Field of the Invention

The invention relates to golf bag assemblages and, in particular, to those golf bag assemblages which include stands which are self-opening and self-closing when they are put down and picked up, respectively, and in which the bottom of the golf bag includes a bottom unit pivotally attached to the bottom of the elongated container of the golf bag, and the bottom portion of the golf bag acts as a pedal for a push rod means which causes the legs of the stand to expand outward to the right and left sides.

2. Background Art

There are numerous golf bags with stands which open when the golf bags to which they are fixed or attached are placed down, and which close when the golf bags are picked up. Most of the golf bags with stands presently being marketed include one pedal which is attached at the end of an activating rod to support one or more stand legs while they are opening. In these stand bags, when pressure is applied to the pedal, it moves upward and causes the legs to expand outward to the right and left sides, while the bottom of the golf bag pivots.

When the ground upon which one of these stand bags is being placed is flat and the surface is hard, the pedal operates well. However, if the ground condition is wet or soft, as for example, after or while it is raining, the pedal is barely functional. Also, in general, in each of these stand bags, the size of the pedal is not as big as is the bottom surface of the bag. Since it is the bottom surface of the bag which touches the ground, it can sink into the mud or any other wet ground base, especially as it pivots. Also, the pedal can hardly support the activating rod as it moves upward when the stand bag is placed down on tall grass.

In one golf bag assemblage presently being marketed, the activating rod of the stand bag pushes up the activating rod, causing it to collapse. Also, the golf bag cannot stand upright, as there is not a backside support rod in the bag. In contrast, in the subject invention, when pressure is applied to the activating rod, the bottom of the golf bag moves upwards and downwards through the inside of the bag body cuff, and the golf bag can stand upright. It should be noted that, in contrast to other golf bag assemblages in which the bottom of the golf bag pivots, with regard to the subject invention, the bottom of the golf bag does not pivot, but rather the bottom of the golf bag includes a bottom unit pivotally attached to the bottom of the elongated container of the golf bag, and the bottom portion of the golf bag acts as a pedal for a push rod means which causes the legs of the stand to expand outward to the right and left sides.

U.S. Pat. No. 5,042,654 (Jones) discloses a golf bag which has legs that are movable between an extended position where they support the bag upright and a retracted position where they are in adjacency with the bag. An actuation mechanism moves the legs to their extended position when the bag is urged downwardly when in a vertical orientation with the actuation mechanism in contact with the ground. The base can be partially relieved to permit downward movement of the bag when the actuation mechanism is in contact with the ground without the actuation mechanism being in contact with the ground when the bag is vertical and the nonrelieved portion of the base is resting on the ground. The ground end of the actuation mechanism doe not lie under or extend under the bottom of the golf bag.

U.S. Pat. No. 1,197,298 (McGregor) discloses a golf bag having a folding stand mechanism. A toggle linkage at the lower portion of the folding stand mechanism has a foot with an inward facing vertical arm extend under the bottom of the golf bag, but it does hold the bottom of the bag off of the ground when the folding stand mechanism is in the extended stage.

BROAD DESCRIPTION OF THE INVENTION

An object of the invention is to overcome disadvantages and problems of prior art golf bag assemblages including stands. An object of the invention is to provide a sturdy golf bag assemblage, the bottom unit, pedal and stand of which can bear heavy weight, and which is not unsteady when placed on uneven (e.g., grass) or unsteady (e.g., wet) ground. A still further object of the invention is to overcome the disadvantages of golf bag assemblages in which the bag body does not keep its shape and collapses or deforms. With regard to the subject invention, the golf bag assemblage keeps its shape, and does not collapse or deform. Other objects and advantages of the invention are set out herein or are obvious herefrom to one skilled in the art.

The invention involves a golf bag assemblage which includes an elongated container for golf clubs, a bottom unit pivotally attached to the bottom of the elongated container so that the bottom unit pivots in relation to the bottom of the elongated container, and leg means attached by attachment means to the outside of upper portion of the elongated container. The attachment means are positioned diametric to the pivotal attachment of the bottom unit, the leg means include legs which are pivotally attached to the attachment means, and the push rod means are attached to the top region of the legs and to the bottom unit diametric to the pivotal attachment of the bottom unit. When the golf bag is tilted in the direction opposite to the pivotal attachment of the bottom unit, the bottom unit, in effect, pivots in relation to the bottom of the elongated container, and the push rod means is moved towards the top of the elongated container, thereby pivoting the legs outward.

The invention comes with a support inside of the bag, where the activating rod is located, to prevent the collapse of the bag body while the bottom functions as it pushes the pedal activating the rod upwards. By keeping the back stationary, the invention allows the bag to stand upright, and allows the bottom of the golf bag to function by moving the bottom up and downward through the inside of the bottom cuffs of the bag. The pedal activated bottom of the bag moves upwards when the activating rod has been pushed, keeping the stand legs in their place. However, when the bag is lifted by the golfer, the bottom moves downward through the inside of the bottom side cuff (lower cuff).

The material strips may be made of any flexible material or materials, such as, webbing, narrow loom fabric or leather piece. The moving height both upwards and downwards is, thus, controlled, so that the bottom of the golf bag stops at a horizontal position when it moves downward.

DETAILED DESCRIPTION OF THE INVENTION

Figure 3:
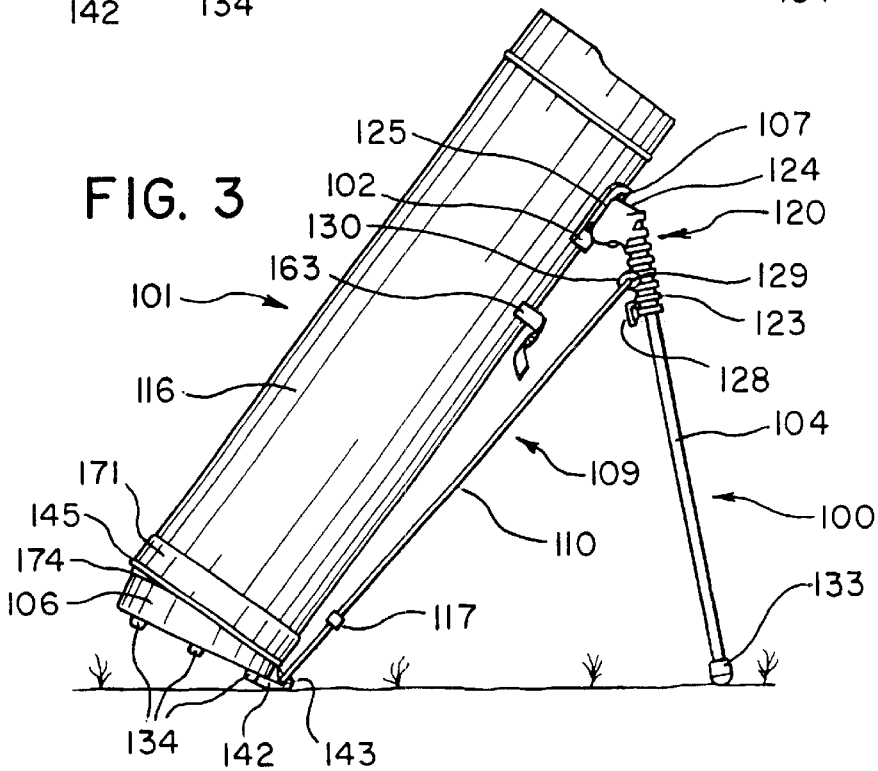
FIG. 3 is a right elevational view of the golf bag shown in FIG. 1 with the stand in an open and extended position.
Figure 15:
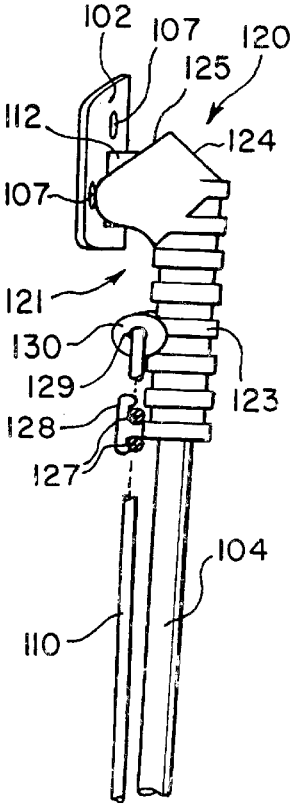
FIG. 15 is a right elevational view of the top hinged portion of the stand shown in FIG. 14.
Figure 16:
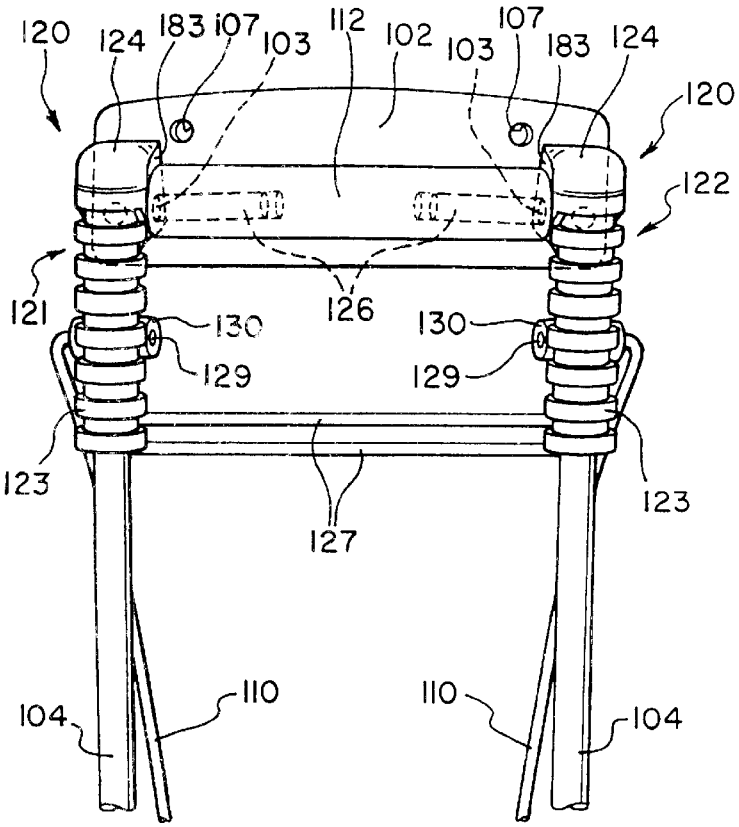
FIG. 16 is a back elevational view of the top hinged portion of the stand shown in FIG. 1.

Generally, stand 100 will be attached to a golf bag 101. One embodiment of the invention is shown in FIGS. 1 to 16. Horizontal hinge 102 is attached to the top portion of golf bag 101, for example, with rivets, through holes 107. Horizontal hinge 102 includes projection 112 in which are two horizontal holes 103. On the top end of each vertical leg 104 of the stand is a mirror image unit (121 and 122) of an adapter 120. Adapter 120 consists of two mirror image units 121 and 122. Each mirror image unit (121 and 122) of adapter 120 has a lower vertical leg 123 which, in turn, has a hole in it into which the end of vertical leg 104 fits. A knob 133 is located on the bottom of each vertical leg 104. As shown in FIG. 15, the top of each lower vertical leg 123 consists of two surfaces, that is, the curved outer portion 124 of the leg of the adapter and the flat upper portion 125 of the leg of the adapter. When the stand 100 is in its open and extended position, as is shown in FIG. 3, the flat upper portion 125 of the leg of the adapter rests against the horizontal hinge 102 attached to the tube portion 116 of the golf bag. Pin or bar 126 extends horizontally from an end 183 of each mirror image unit (121 and 122) of the adapter 120. Each pin 126 pivotally fits in one of the two horizontal holes 103 in projection 112 of horizontal hinge 102. The mirror image units (121 and 122) of adapter 120 and pins 126 have a slight outward and upward orientation so as to readily fit in holes 103. As is shown in FIG. 16, elastic band 127 fits over hooks 128 on the back of lower vertical legs 123, and helps to hold pins 126 in holes 103. Elastic band 127 also resists the spread of vertical legs 104 when golf bag 101 is tilted, and, then, also helps to pull vertical legs 104 back together to their original vertical, generally parallel orientation.

Figure 10:
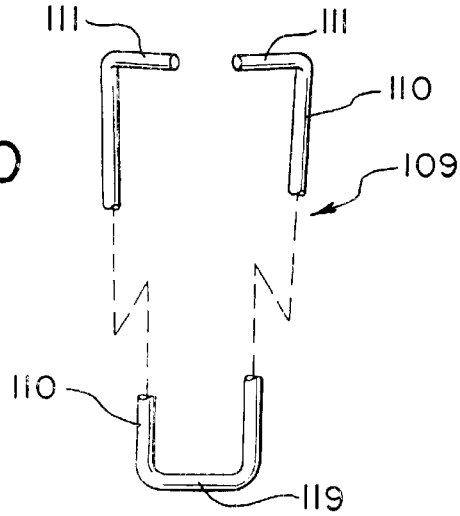
FIG. 10 is a back elevational view of the push rod of the stand shown in FIG. 1.
Figure 11:
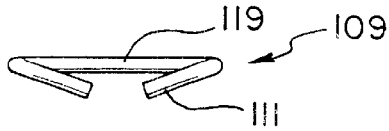
FIG. 11 is a top elevational view of the push rod of the stand in FIG. 1.
Figure 13:
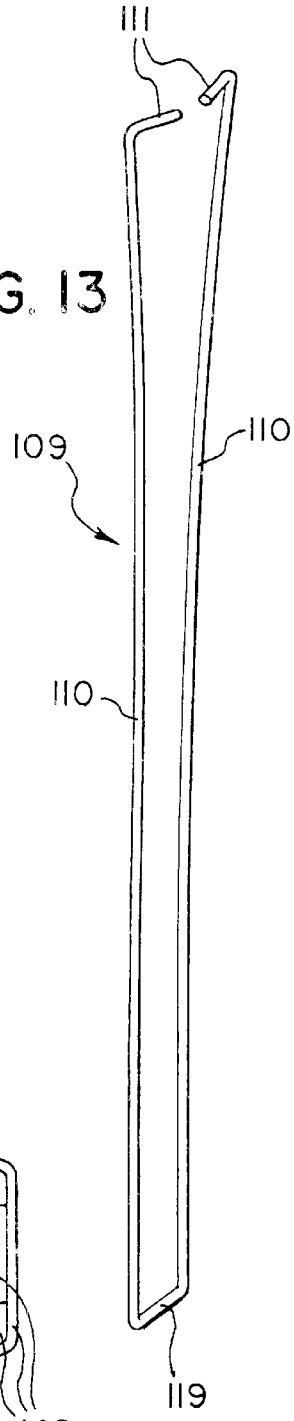
FIG. 13 is a back perspective view of the push rod of the stand shown in FIG. 1.
Figure 12:
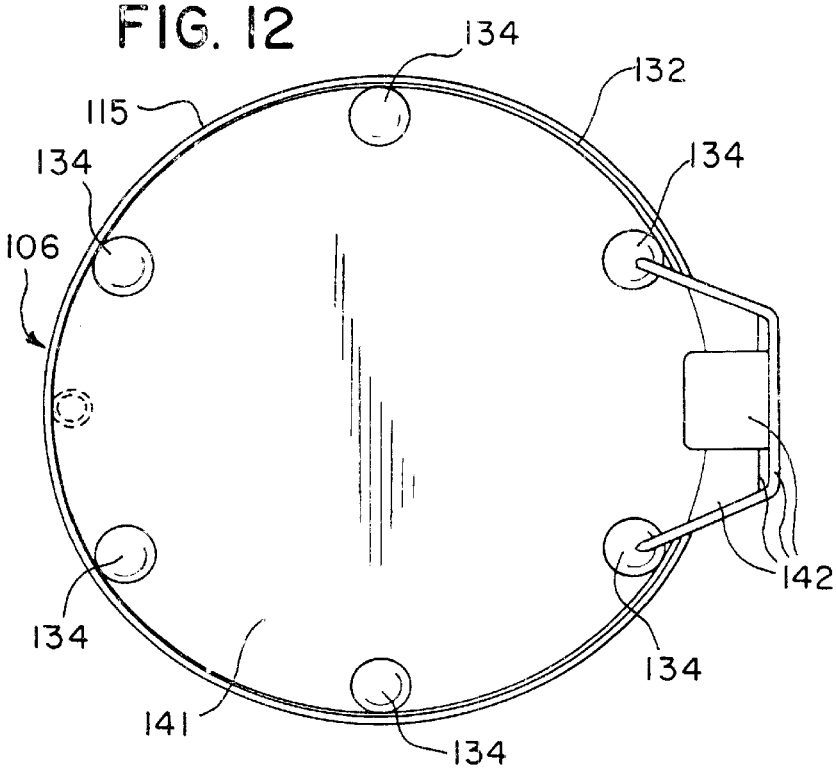
FIG. 12 is a bottom elevational view of the base of the golf bag shown in FIG. 1.
Figure 14:
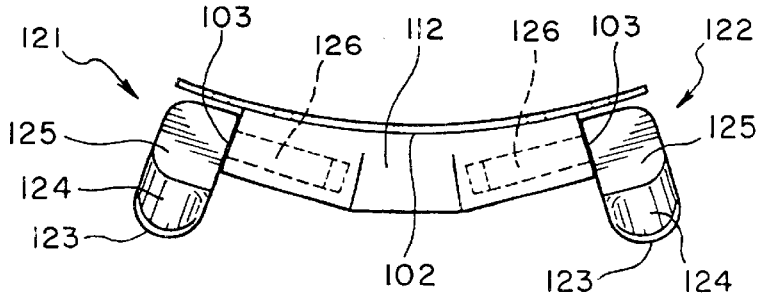
FIG. 14 is a top elevational view of the top hinged portion of the stand shown in FIG. 1.

As shown best in FIGS. 10 and 13, push rod 109 has two vertical rods 110, two top cross bars 111, and a horizontal bar 119 which hooks into the hook 143 of the push rod tail anchor 142 which extends from the lower portion of the rigid base 106. As shown best in FIGS. 1 and 13, vertical rods 110 are generally parallel but are slightly slanted outward in their top portion. Each of the top cross bars 111 of the push rod 109 is pivotally positioned in a hole 129 in a mounting 130 located on the back, of each of the lower vertical legs 123 of each adapter 120 above hook 128. Push rod 109 is composed of a resilient metal (e.g., spring steel) so that the spring action thereof holds top cross bars 111 in holes 129, and so that vertical rods 110 bend outwardly when the golf bag 101 is tilted and the vertical legs 104 of the stand expand outward to the right and left sides. As shown best in FIG. 1, clip 117 is mounted around vertical rods 110, near their bottom portion to hold the vertical rods together.

Figure 4:
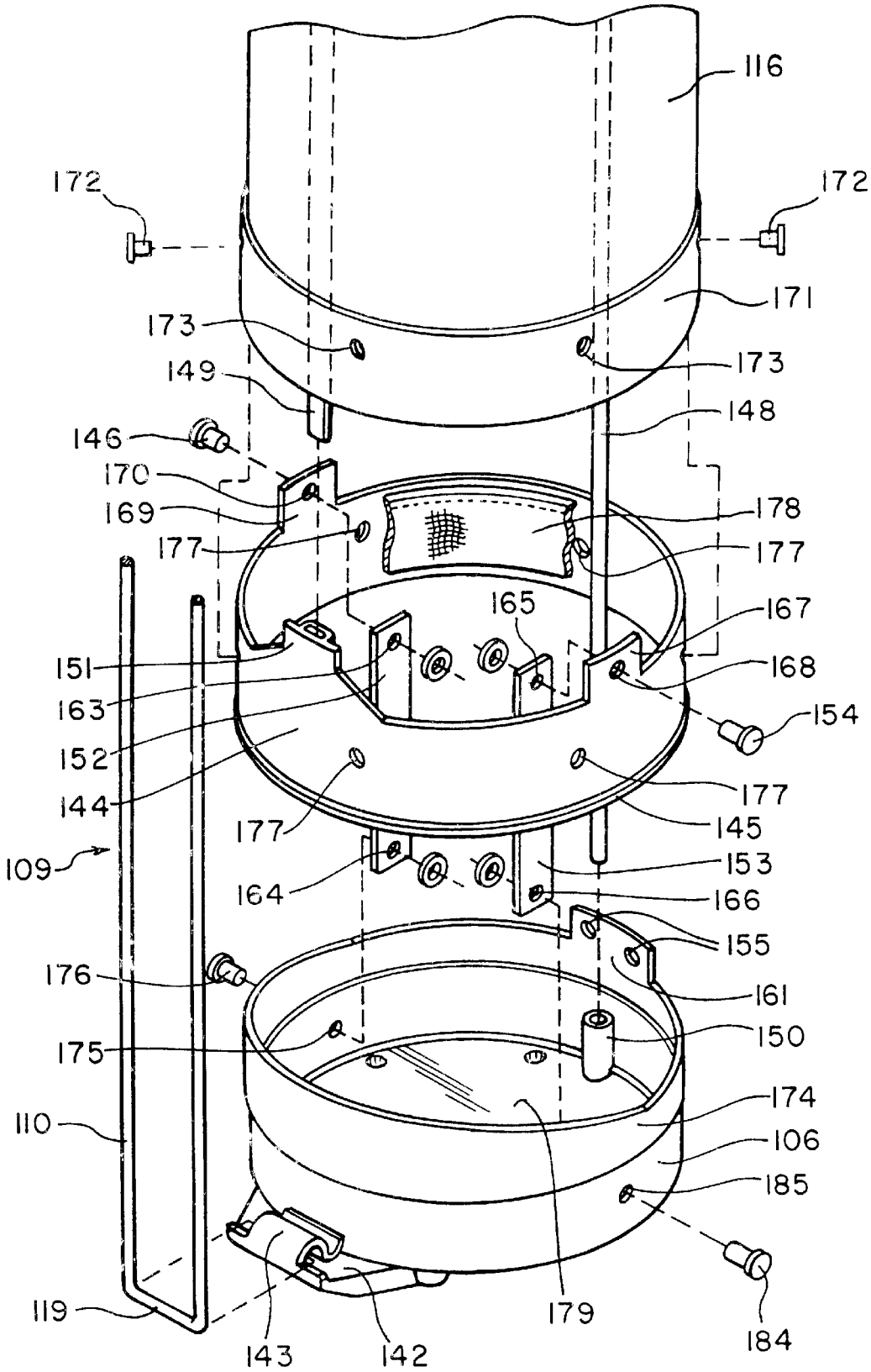
FIG. 4 is an exploded view of the lower portion of a back perspective view of a first embodiment of the golf bag and stand shown in FIG. 1.
Figure 5:
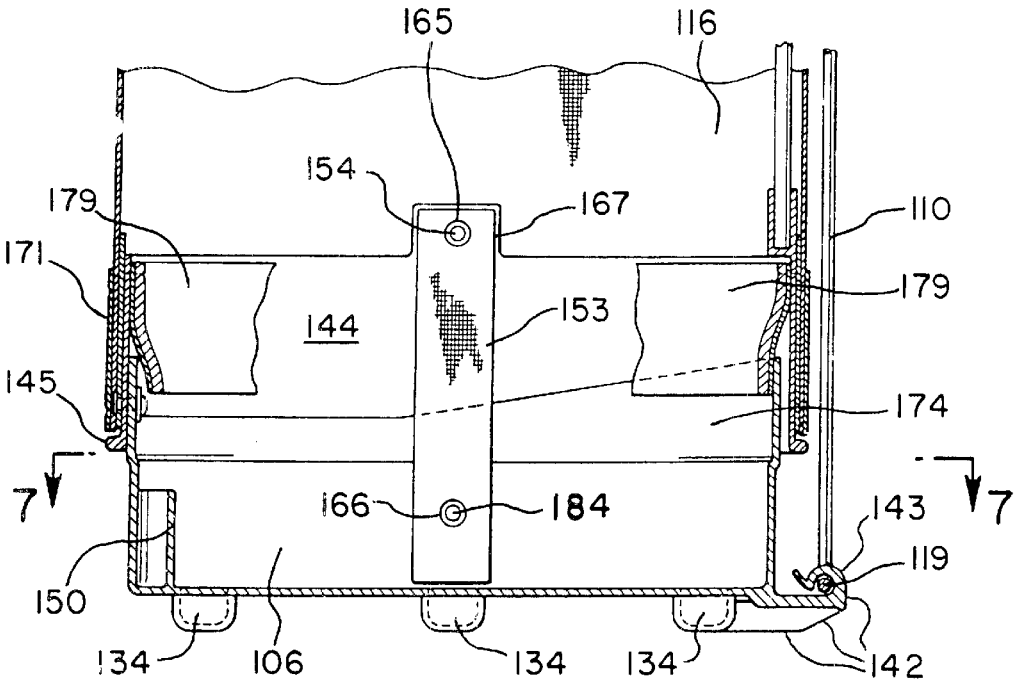
FIG. 5 is a cross-sectional view of the lower portion of the golf bag shown in FIG. 1 in an upright position (including the rigid base, the inner collar of the rigid base and the tube portion of the golf bag)
Figure 6:
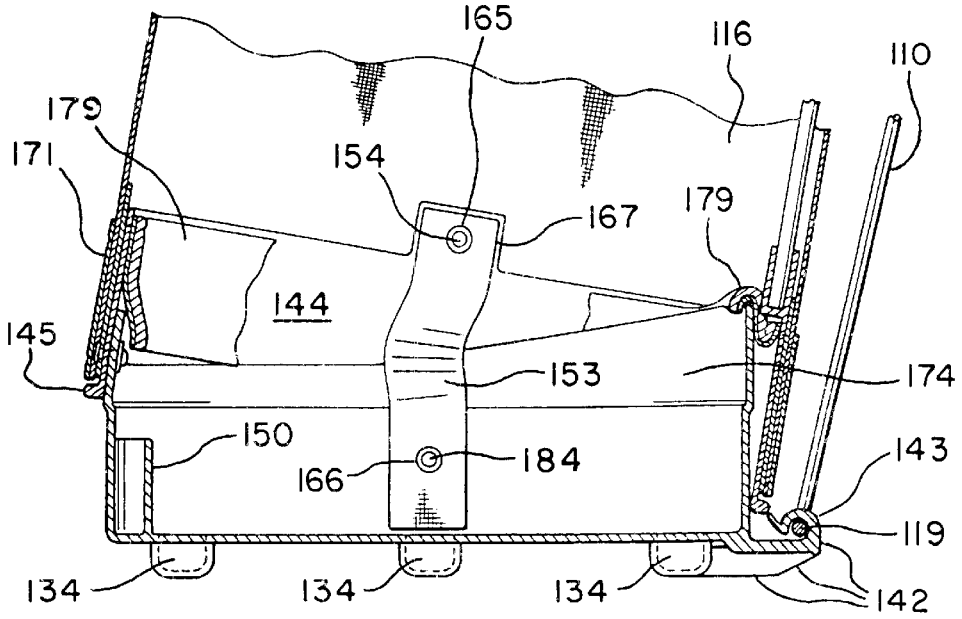
FIG. 6 is a cross-sectional view of the lower portion of the golf bag shown in FIG. 1 where the attached stand is in an open and extended position (including the rigid base, the inner collar of the rigid base and the tube portion of the golf bag)
Figure 7:
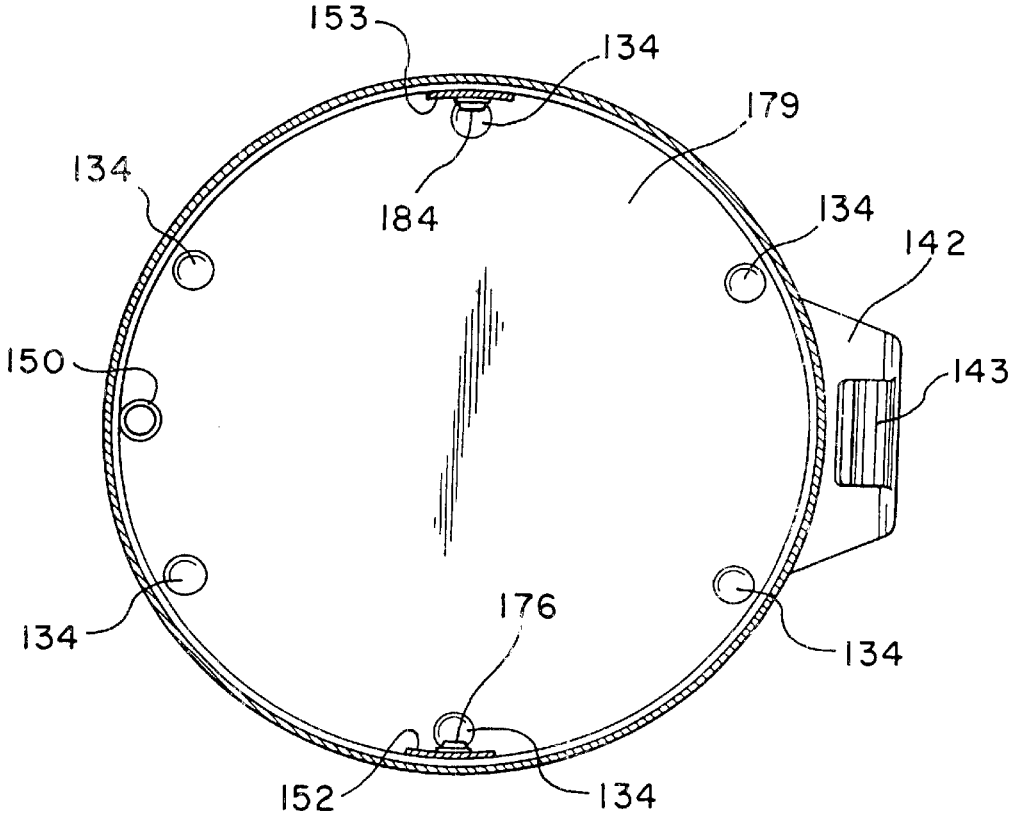
FIG. 7 is a top elevational view of the lower portion of the rigid base and push rod tail anchor of the golf bag shown in FIG. 1.
Figure 8:
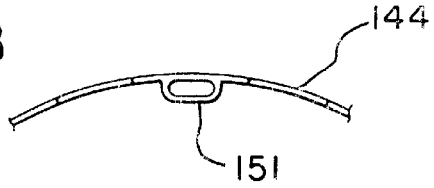
FIG. 8 is a top elevational view of the inner collar above the rigid base and second rod holder of a second embodiment of the golf bag shown in FIG. 1.
Figure 9:
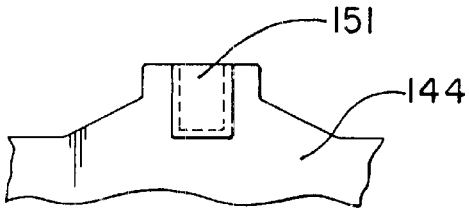
FIG. 9 is a cross-sectional view of the inner collar above the rigid base and second rod holder of the golf bag shown in FIG. 1.

As shown best in FIG. 4, the rigid base has an upper portion 174 which extends from the lower portion 106, and a floor 179. Six knobular projections 134 extend from the floor 179 of the rigid base. A projection 161, in which there are holes 155, extends from the upper portion 174 of the rigid base. The upper portion of rigid base 174 fits within the inner collar above the rigid base 144. The outer collar 171 of the tube portion 116 of the golf bag slides over the inner collar 144 above the rigid base. Rivets or other attaching means 172 secure the outer collar 171 of the tube portion 116 of the golf bag through holes 173 in the outer collar 171 and through holes 177 in the inner collar 144 above the rigid base to the inner collar 144 above the rigid base. The inner collar 144 above the rigid base includes a first projecting portion 167 and a second projecting portion 169, and a rim 145.

As is shown in FIG. 4, hole 163 in one end of a first material strip 152 is attached by, for example, rivet or other attaching means 146 through hole 170 to the second projecting portion 169 of the inner collar 144. A hole 164 in the other end of first material strip 152 is attached by, for example, rivet or other attaching means 176 through hole 175 to the lower portion of the rigid base 106.

As is shown in FIG. 4, hole 165 in one end of second material strip 153 is attached by, for example, rivet or other attaching means 154 through hole 168 to the first projecting portion 167 of the inner collar 144. A hole 166 in the other end of second material strip 152 is attached by, for example, rivet or other attaching means 184 through hole 185 to the lower portion of the rigid base 106.

As is shown in FIG. 4, first rod 148 is placed in the first rod holder 150. The first rod holder 150 projects from the floor 179 of the rigid base and runs along a side of the lower portion 106 of the rigid base. The first rod 148 extends up into the tube of the golf bag past the inner collar 144 above the rigid base between the rivets or other attaching means which pass through holes 155 in the projecting portion 161 of the upper portion of the rigid base. The projecting portion 161 of the upper portion of the rigid base is attached to the inner collar 144 above the rigid base.

As is shown in FIG. 4, second rod 149 is placed in the second rod holder 151. The second rod holder 151 runs along and projects from the third projecting portion 186 of the inner collar 144.

A layer of material 178 may run around the inner surface of the inner collar 144 above the rigid base.

Figure 1:
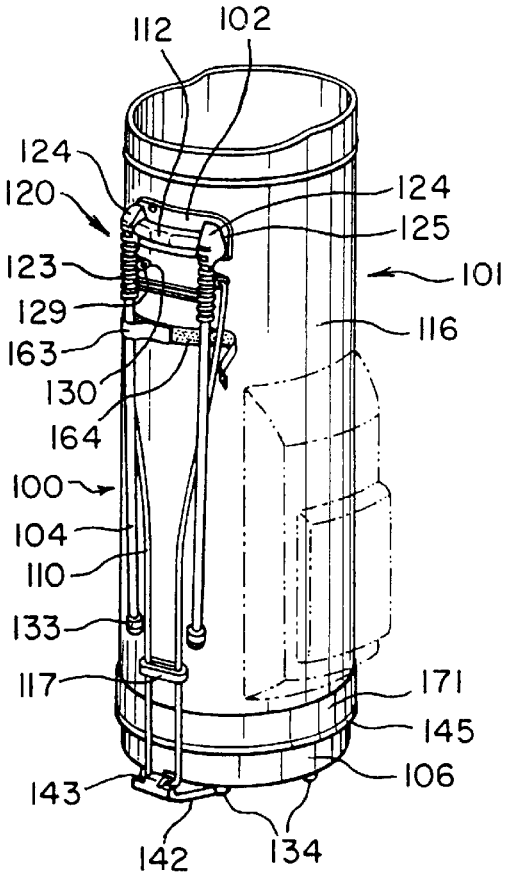
FIG. 1 is a back perspective view of a first embodiment of the golf bag with stand of the invention.
Figure 2:
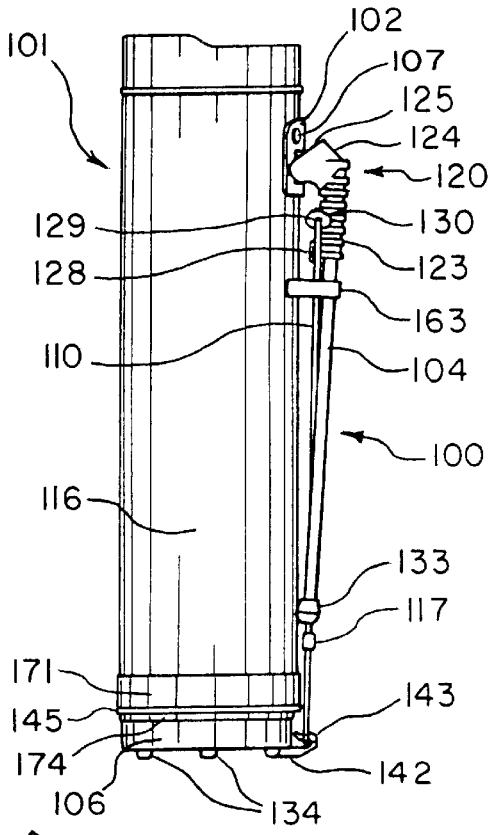
FIG. 2 is a right elevational view of the golf bag shown in FIG. 1.

As is shown in FIGS. 1 and 3, two attaching bands, each made, for example, of VELCRO (including a band of hooks 181 and a band of loops 182) are attached to the golf bag tube directly below the level of the lower vertical legs 123 of the adapter 120. When the golf bag is upright, the attaching bands of hooks can be brought over top of both the vertical legs 104 of the stand and the two vertical rods 110 of the push rod and attached to the two bands of loops 182, thereby holding the stand 100 and push rod 109 stationary against the golf bag 101.

Attached to the upper rim of the golf bag by, for example, a C-ring may be two shoulder straps. These shoulder straps may attach to the surface of the golf bag at their other ends approximately half way down the golf bag. Together, the shoulder straps may be used to hold the golf bag as would one hold a back pack, that is, with one shoulder strap running across each shoulder of a person.

In operation, the use of golf bag 101 tilts the top of golf bag 101. The tilting action pushes against the push rod tail anchor 142. The bottom of the golf bag stand, then, acts as a pedal for the actuating rod. As is shown best in FIGS. 5 and 6, the inner collar 144 above the rigid base slides within the upper portion 174 of the rigid base on the side of the push rod tail anchor 143. The pressure is transmitted up against pivot points 129 of the upper portions of vertical legs 104. (The bottom of vertical rods 110 rest against the ground when golf bag 101 is tilted). As a result, the bottom of vertical legs 104 move outwardly and away from each other so as to maintain a somewhat vertical orientation, so as to provide a tripod stability for tilted golf bag 101 (see FIG. 3). When golf bag 101 is raised back to the vertical, vertical legs 104 and other parts return to their original positions and orientation.

LIST OF PARTS

100 stand
101 golf bag
102 horizontal hinge
103 horizontal holes in horizontal hinge
104 vertical legs of stand
106 lower portion of rigid base
107 holes through which horizontal hinge can be attached to golf bag
109 push rod
110 two vertical rods of push rod
111 two top cross bars of push rod
112 projection of horizontal hinge
116 tube portion of golf bag
117 clip
119 horizontal bar
120 adapter
121 top of adapter
122 left side of adapter
123 lower vertical leg of adapter
124 curved outer portion of leg of adapter
125 flat upper portion of leg of adapter
126 pin or bar
127 elastic band
128 hooks
129 pivot points of the two vertical rods 110 of the push rod
130 mountings
133 knobs
134 projections from the bottom of the lower rigid base 106
142 push rod tail anchor
143 hook of push rod tail anchor
144 inner collar above rigid base
145 rim of inner collar above rigid base
146 rivets or other attaching means in 152 and 170
148 first rod
149 second rod
150 first rod holder
151 second rod holder
152 first material strip
153 second material strip
154 rivet or other attaching means in 153 and 168
155 holes in projecting portion of rigid base
159 rivets or other attaching means passing through holes 155 in projecting portion of rigid base
161 projecting portion of upper portion of rigid base
163 first hole in first material strip 152
164 second hole in first material strip 152
165 first hole in second material strip 153
166 second hole in second material strip 153
167 first projecting portion of inner collar
168 hole in first projecting portion of inner collar
169 second projecting portion of inner collar
170 hole in second projecting portion of inner collar
171 outer collar
172 rivet or other attaching means
173 holes in outer collar through which rivet or other attaching means 172 passes
174 upper portion of rigid base
175 hole in lower portion of rigid base
176 rivet or other attaching means in 175
177 holes in inner collar above rigid base through which rivet or other attaching means 172 passes
178 material

What is claimed is:

1. A golf bag assemblage, comprising:

(a) an elongated container for golf clubs having an upper end, a lower end, an upper portion, and an inside and an outside, and having a skirt on the lower end;

(b) a bottom unit pivotally attached to the lower end of the elongated container, the bottom unit has a flat bottom that is undivided and nonflexible and that is unitary with other parts of the bottom portion; and (c) leg means attached by leg attachment means to outside of the upper portion of the elongated container, the leg attachment means being positioned diametric to the pivotal attachment of the bottom unit, the leg means including legs which are pivotally attached to the leg attachment means, and push rod means attached to top region of the legs and to the bottom unit diametric to the pivotal attachment of the bottom unit, the flat bottom of the bottom unit being perpendicular to central axis of the bottom unit and the elongated container, respectively, when the golf bag is tilted in direction opposite to the pivotal attachment of the bottom unit, the top unit pivots in relation to the bottom unit with the skirt of the lower end of the elongated container moving downward and outside of the bottom unit so as to cover side of the bottom unit in region where the leg attachment means is located, and the flat bottom of the bottom unit remains flat, and the push rod means is moved towards top of the elongated container, thereby pivoting the legs outward.

2. A golf bag assemblage comprising:

(a) a golf bag having an upper portion and a bottom portion, the bottom portion is pivotally attached to lower end of the upper portion and wherein the bottom portion of the golf bag has a flat bottom that is undivided and nonflexible and that is unitary with other parts of the bottom portion, a skirt is on the lower end of the upper portion; and (b) a stand for the golf bag, the stand comprising:

(i) support means having two legs and a top cross segment, the top end of each of the two legs being a short, inwardly-facing cross bar which is pivotally attached to the top cross segment, and both of the legs extending downward, the top cross segment being affixed to the upper portion of the golf bag, each of the two legs having a top region below the top end thereof;

(ii) the push rod means having two vertical resilient side rods, a short, inwardly-facing cross bar on the top end of each of the push rods, each of the short cross bars (ii) being pivotally mounted to one of the said legs below the pivotal attachments, and a horizontal bar which hooks into a push rod tail anchor attached to the bottom portion of the golf bag and to which lower end of each of the two side rods is attached; and (iii) elastic means attached between the top region of each of the two legs of the support means below the pivotal mountings of the two side rods of the rod means, the tension of the elastic means urging the two legs of the support means back into alignment with the golf bag, and the pressure on the horizontal bar of the push rod means causing two legs of the support means to swing out of alignment with the golf bag to provide support for the golf bag when the golf bag is in a slanted position, when the golf bag is tilted in direction opposite to the pivotal attachment of the bottom portion, lower end of the upper portion of the golf bag moves downward and outside of the bottom portion so as to cover side of the bottom portion of the golf bag in region where the pivotal attachment is located, and the flat bottom of the bottom portion remains flat.

3. The golf bag assemblage of claim 2 wherein the golf bag includes a tube portion, and the bottom portion of the golf bag comprises a rigid base, an inner collar above the rigid base over which the tube portion of the golf bag is attached, first attaching means to secure a portion of the inner collar to the rigid base, and at least one strip or second attaching means so that the inner collar above the rigid base is secured to, but partially can slide over, and inside of the rigid base.

4. The golf assemblage of claim 2 wherein the golf bag includes a tube portion, and the bottom portion of the golf bag comprises a rigid base, an outer collar above the rigid base over which the tube portion of the golf bag is attached, first attaching means to secure a portion of the outer collar to the rigid base, and at least one strip or second attaching means so that the outer collar above the rigid base is secured to, but partially can slide over and of, the rigid base.

* * * * *